US009756969B2

(12) United States Patent
Civelli

(10) Patent No.: US 9,756,969 B2
(45) Date of Patent: Sep. 12, 2017

(54) MULTI-CHAMBERED DRINKING VESSEL

(71) Applicant: Joshua Vincent Civelli, Granby, MA (US)

(72) Inventor: Joshua Vincent Civelli, Granby, MA (US)

( * ) Notice: Subject to any disclaimer, the term of this patent is extended or adjusted under 35 U.S.C. 154(b) by 0 days.

(21) Appl. No.: 14/934,267

(22) Filed: Nov. 6, 2015

(65) Prior Publication Data

US 2016/0130035 A1 May 12, 2016

Related U.S. Application Data

(60) Provisional application No. 62/077,216, filed on Nov. 8, 2014.

(51) Int. Cl.

| | |
|---|---|
| ***B65D 25/06*** | (2006.01) |
| ***B65D 23/04*** | (2006.01) |
| ***A47G 19/22*** | (2006.01) |
| *A47G 19/12* | (2006.01) |

(52) U.S. Cl.

CPC .... *A47G 19/2205* (2013.01); *A47G 2019/122* (2013.01); *A47G 2200/10* (2013.01)

(58) Field of Classification Search

CPC ..... B65D 2217/04; B65D 23/04; B65D 81/32
USPC ..... 220/502, 531, 529, 230, 825, 506, 505, 220/501, 828, 715, 714, 711; 215/6, 215/DIG. 8; 222/145.4, 145.5; 221/133; 206/1.5, 221, 818
See application file for complete search history.

(56) References Cited

U.S. PATENT DOCUMENTS

| | | | | |
|---|---|---|---|---|
| 1,272,443 | A * | 7/1918 | Himmelberger | A24F 19/06 220/502 |
| 3,470,885 | A * | 10/1969 | Lebel | A24F 19/06 131/242 |
| 5,607,140 | A * | 3/1997 | Short, III | F16K 1/226 251/305 |
| 8,733,578 | B2 | 5/2014 | Michaels | |
| 2009/0309056 | A1 * | 12/2009 | Tsai | F16K 1/222 251/231 |
| 2012/0285843 | A1 * | 11/2012 | Devlin | A47G 19/2266 206/221 |

* cited by examiner

*Primary Examiner* — J. Gregory Pickett
*Assistant Examiner* — Allan Stevens
(74) *Attorney, Agent, or Firm* — Grogan, Tuccillo & Vanderleeden, LLP

(57) ABSTRACT

A dual-chambered drinking vessel includes a vessel body having at least one sidewall, a bottom and an open top defining an interior space, a flapper, and an actuator mechanism. The flapper is disposed within the interior space and is pivotally connected to an inner wall of the vessel body. The flapper is movable between a closed position in which the flapper divides the interior space into an upper chamber and a lower chamber and substantially prevents fluid communication between the upper chamber and the lower chamber, and an open position in which the upper chamber is in fluid communication with the lower chamber. The actuator mechanism is selectively actuatable to move the flapper from the closed position to the open position.

12 Claims, 24 Drawing Sheets

MULTI-CHAMBERED DRINKING VESSEL

CROSS-REFERENCE TO RELATED APPLICATIONS

This application claims the benefit of U.S. Provisional Application Ser. No. 62/077,216, filed on Nov. 8, 2014, which is herein incorporated by reference in its entirety.

FIELD OF THE INVENTION

The present invention relates generally to vessels and, more particularly, to a multi-chambered vessel for liquids.

BACKGROUND OF THE INVENTION

Shots of liquor are commonly consumed by bar patrons who are interested in trying new liquors or consuming a higher proof drink. Hard liquors, however, often have a harsh taste that leaves a burning sensation in the mouth of a user after the beverage is consumed. Accordingly, some people prefer to have a mild drink, often referred to as a chaser, immediately after consuming a shot of hard liquor in order to make the shot more palatable. Drinks such as soda, fruit or vegetable juice, or even water can be used as chasers to quench some of the burning sensation experienced by shot-drinkers. Aside from the possible harsh taste, some hard liquor is mildly caustic to the soft tissues of the human mouth and throat. These liquors should be washed down promptly after a user tastes the drink, to avoid extended exposure to the alcohol.

Typically, when consuming a shot utilizing a chaser, a shot is poured into one vessel while a chaser beverage is poured into another. The consumer drinks the shot from the first vessel, followed by the chaser beverage from the second vessel. Certain devices exist that combine the shot and chaser into a single vessel. These devices typically have two chambers, one for the shot and one for the chaser. Such devices, however, often require two hands to operate, or mix the two different liquids prior to consumption.

For example, U.S. Pat. No. 8,733,578 discloses a dual-chambered beverage container that has a hinged divider that serves to separate the two chambers. The problem with this, however, is that the divider is incapable of restricting the flow of liquid out of the lower chamber as the container is tilted about its vertical axis in efforts to consume the liquid in the upper chamber, resulting in mixing of the liquids prior to consumption. Preventing the fluids from mixing while emptying the container has an added benefit of experiencing the full taste of the first fluid, and then, a time step later, the full taste of the second fluid to quench the unpleasant burning sensation. The configuration of existing devices results in a slight mixing action during pouring which effectively creates a diluted liquid in both chambers, resulting in the loss of the pure tastes of each fluid individually. In other words, the user can taste the lower chamber's fluid as the user is simultaneously consuming the upper chamber's fluid, which is undesirable.

Other devices, while effectively separating the fluid into two chambers, require both hands for operation. Utilizing both hands for operation can be tiring, confusing, and impractical for consumers with other objects in their hands such as a phone or a drink.

In view of the above, there is a need for a multi-chambered drinking vessel that allows a user to quickly and easily consume a shot, followed immediately by a chaser, without mixing of the shot and the chaser prior to consumption, and which is easily operable using one hand.

SUMMARY OF THE INVENTION

It is an object of the present invention to provide a drinking vessel.

It is another object of the present invention to provide a dual-chambered drinking vessel.

It is another object of the present invention to provide a dual-chambered drinking vessel that is operable to selectively release a second liquid after a first liquid is consumed.

It is another object of the present invention to provide a dual-chambered drinking vessel that provides a user with the ability to control when the fluid from each chamber is released.

It is another object of the present invention to provide a dual-chambered drinking vessel that is easily operable with one hand.

It is another object of the present invention to provide a dual-chambered drinking vessel that allows a first fluid to be consumed without mixing with a second fluid.

According to an embodiment of the present invention, a dual-chambered drinking vessel is provided. The vessel includes a vessel body having at least one sidewall, a bottom and an open top defining an interior space, a flapper, and an actuator mechanism. The flapper is disposed within the interior space and is pivotally connected to an inner wall of the vessel body. The flapper is movable between a closed position in which the flapper divides the interior space into an upper chamber and a lower chamber and substantially prevents fluid communication between the upper chamber and the lower chamber, and an open position in which the upper chamber is in fluid communication with the lower chamber. The actuator mechanism is selectively actuatable to move the flapper from the closed position to the open position.

According to another embodiment of the present invention, a vessel is provided. The vessel includes a vessel body defining an interior space, a dividing flapper pivotally connected to an inner wall of said vessel body, the dividing flapper separating the interior space into an upper chamber and a lower chamber, and an actuator configured to selectively move the dividing flapper between a first position, in which the dividing flapper sealingly engages the inner wall to prevent fluid communication between the upper chamber and the lower chamber, and a second position, in which the dividing flapper is oriented so as to allow fluid to flow between the upper chamber and the lower chamber.

According to yet another embodiment of the present invention, a method of operating a dual-chambered drinking vessel having a lower chamber, an upper chamber and a dividing flap separating the lower chamber from the upper chamber is provided. The method includes the steps of depressing a trigger to move the dividing flap to an open position, the open position providing fluid communication between said upper chamber and said lower chamber, pouring a first liquid into the lower chamber, releasing said trigger to move the dividing flap to a closed position, the closed position preventing fluid communication between the upper chamber and the lower chamber, and pouring a second liquid into said upper chamber.

BRIEF DESCRIPTION OF THE DRAWINGS

The present invention will be better understood from reading the following description of non-limiting embodiments, with reference to the attached drawings, wherein below.

DETAILED DESCRIPTION OF THE PREFERRED EMBODIMENT

Figure 1:
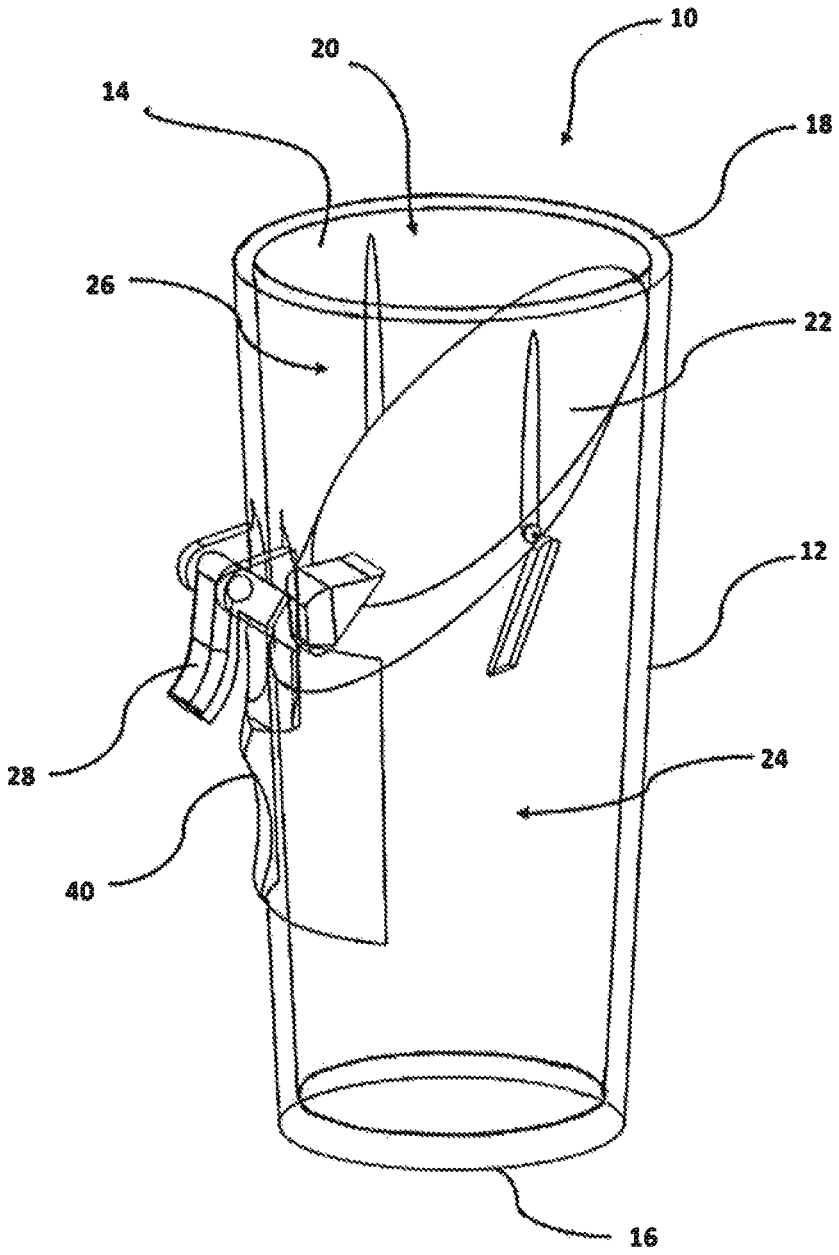
FIG. 1 is a perspective view of a dual-chambered drinking vessel in accordance with an embodiment of the present invention.

With reference to FIGS. 1-15, a dual-chambered drinking vessel 10 according to an embodiment of the present invention is illustrated. As shown therein, the drinking vessel 10 includes a vessel body 12 having at least one interior sidewall 14, a bottom wall 16 and a generally open top defined by rim 18. The vessel body 12 defines an interior space 20. In an embodiment, the vessel body 12 is generally cylindrical or frustoconical in shape, although the vessel body 12 may be formed in any shape, such as rectangular, triangular, elliptical and the like without departing from the broader aspects of the present invention.

Figure 2:
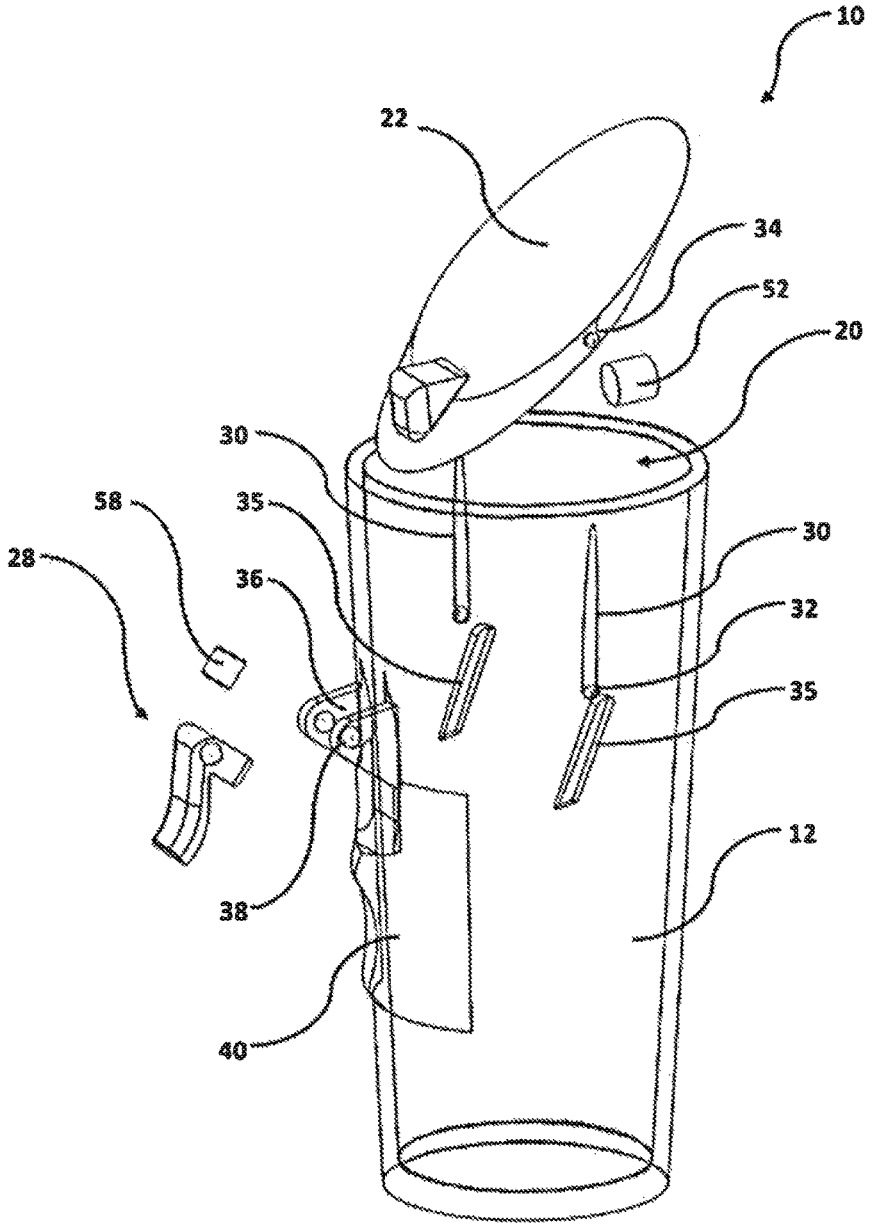
FIG. 2 is an exploded, perspective view of the dual-chambered drinking vessel of FIG. 1.
Figure 3:
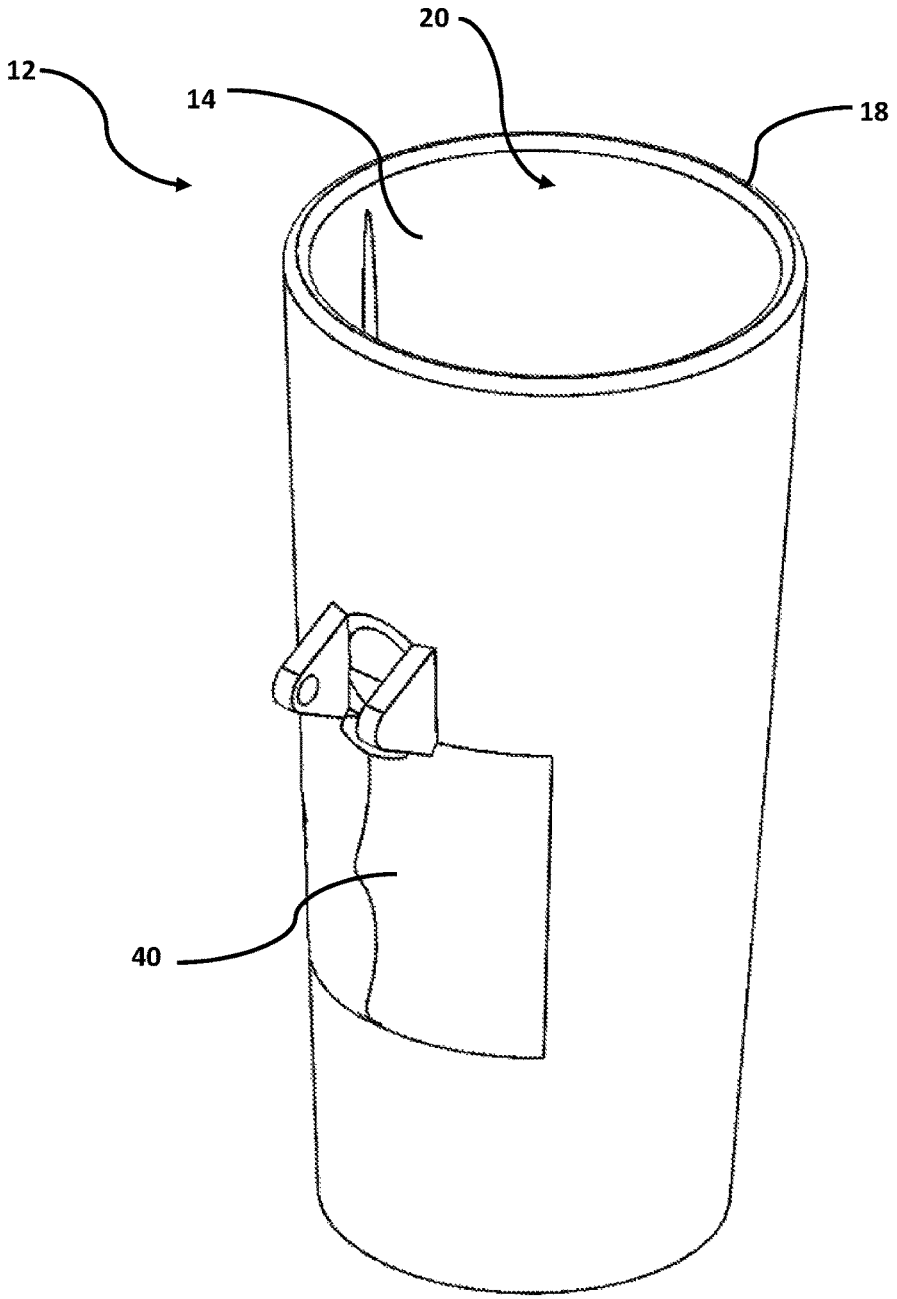
FIG. 3 is a perspective view of a vessel body of the dual-chambered drinking vessel of FIG. 1.
Figure 4:
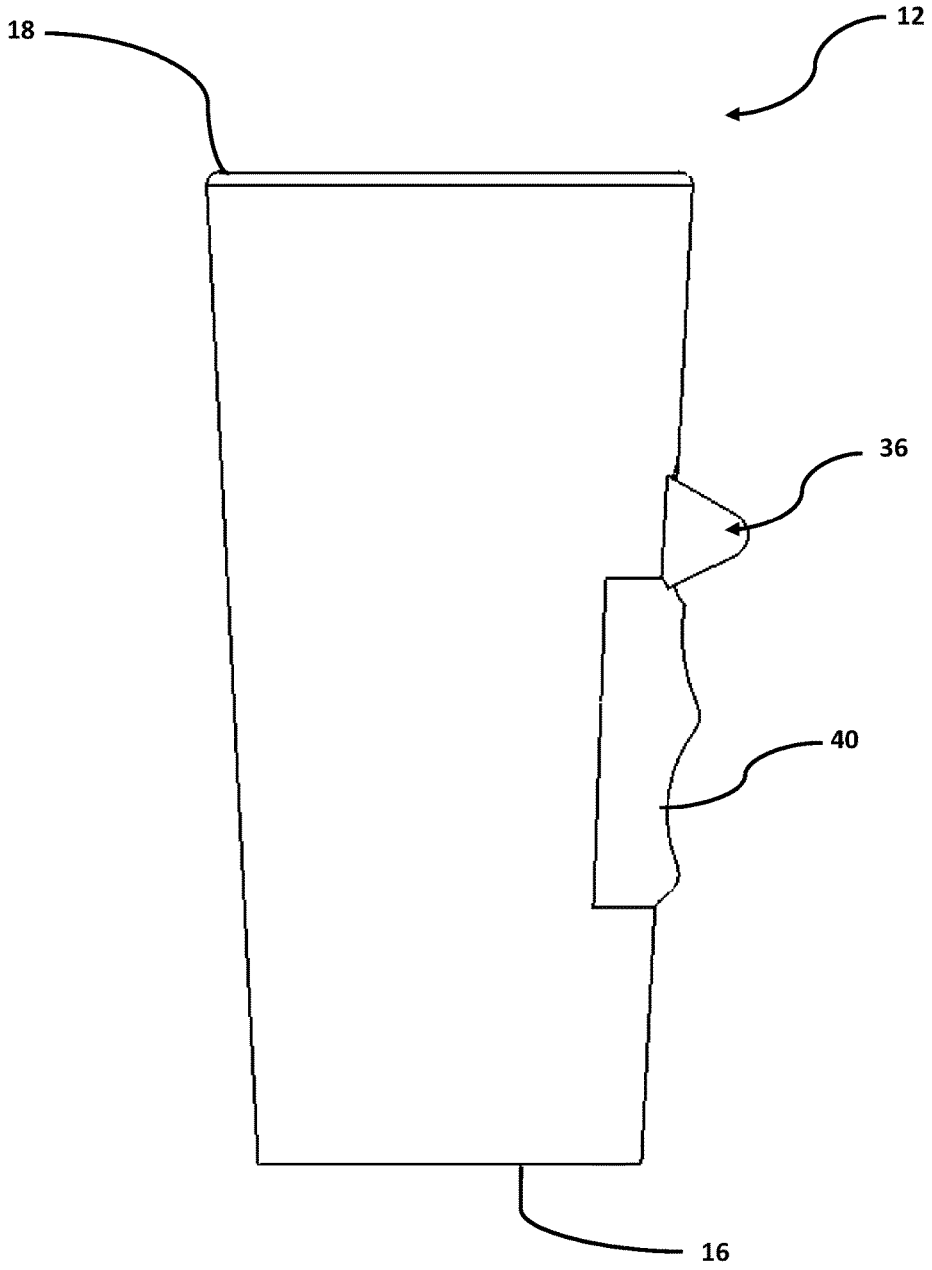
FIG. 4 is a side, elevational view of the vessel body.

As best shown in FIG. 1, the vessel 10 includes a baffle or flapper 22 pivotally mounted to the interior sidewall 14 of the vessel 10 within the interior space 20. The flapper 22 is sized and shaped to sealingly contact the interior sidewall 14 of the vessel 10, as discussed in detail below, and divides the interior space 20 into a lower chamber 24 and an upper chamber 26. In particular, where the vessel body 12 is cylindrical or frustoconical in shape, the flapper may be elliptical in shape. The flapper 22 is selectively movable between a closed position, in which the flapper 22 sealingly contacts the interior sidewall 14 of the vessel 10 to divide the interior space 20 into the lower and upper chambers 24, 26, and an open position, in which the flapper 22 is generally spaced from the interior sidewall 14 allowing fluid communication between the lower chamber 24 and upper chamber 26. With further reference to FIGS. 1 and 2, the vessel 10 also includes an actuator mechanism, such as a trigger 28, which is actuatable to move the flapper 22 between the closed position and open position, in the manner discussed hereinafter.

Figure 5:
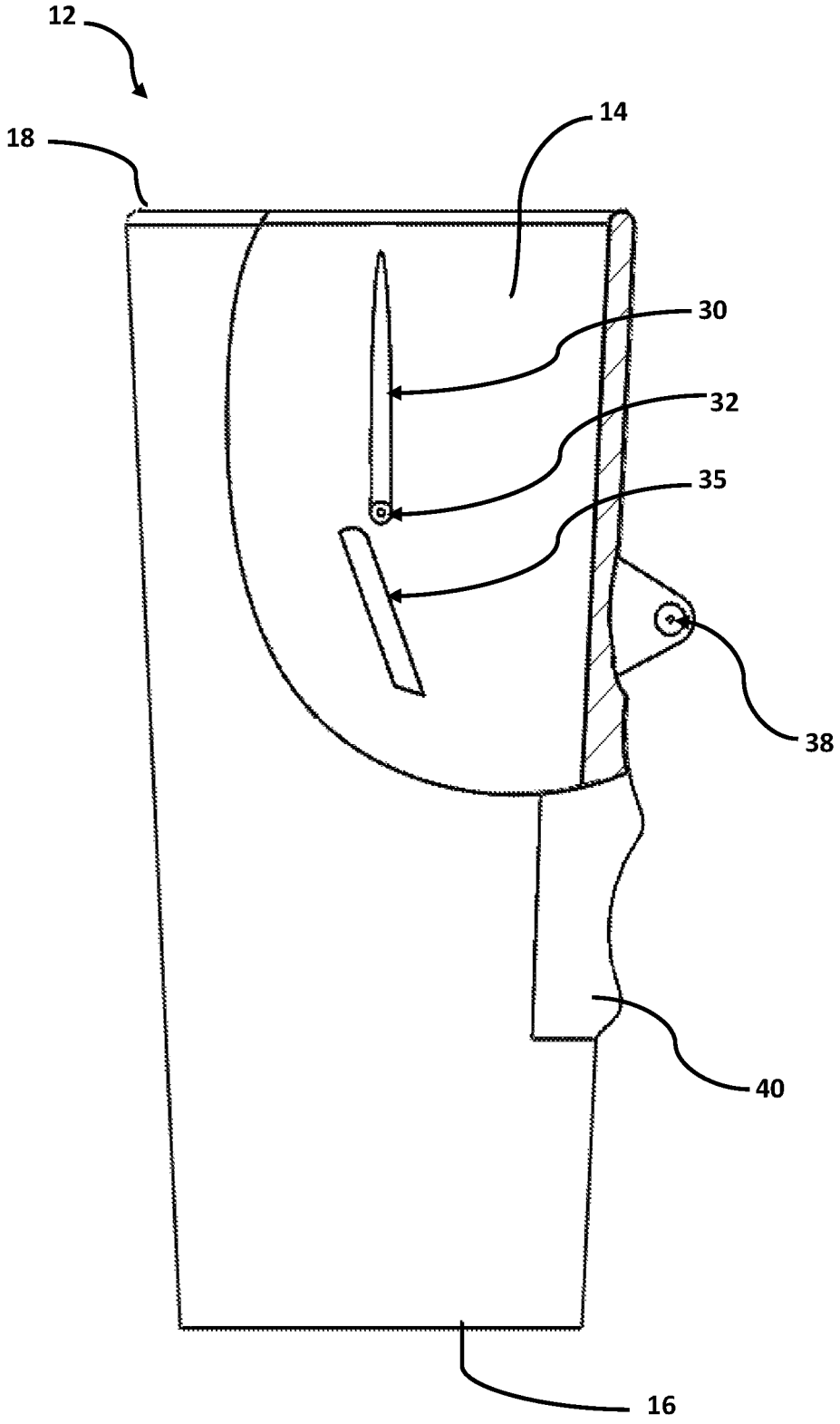
FIG. 5 is a side, partial cross-sectional view of the vessel body.
Figure 6:
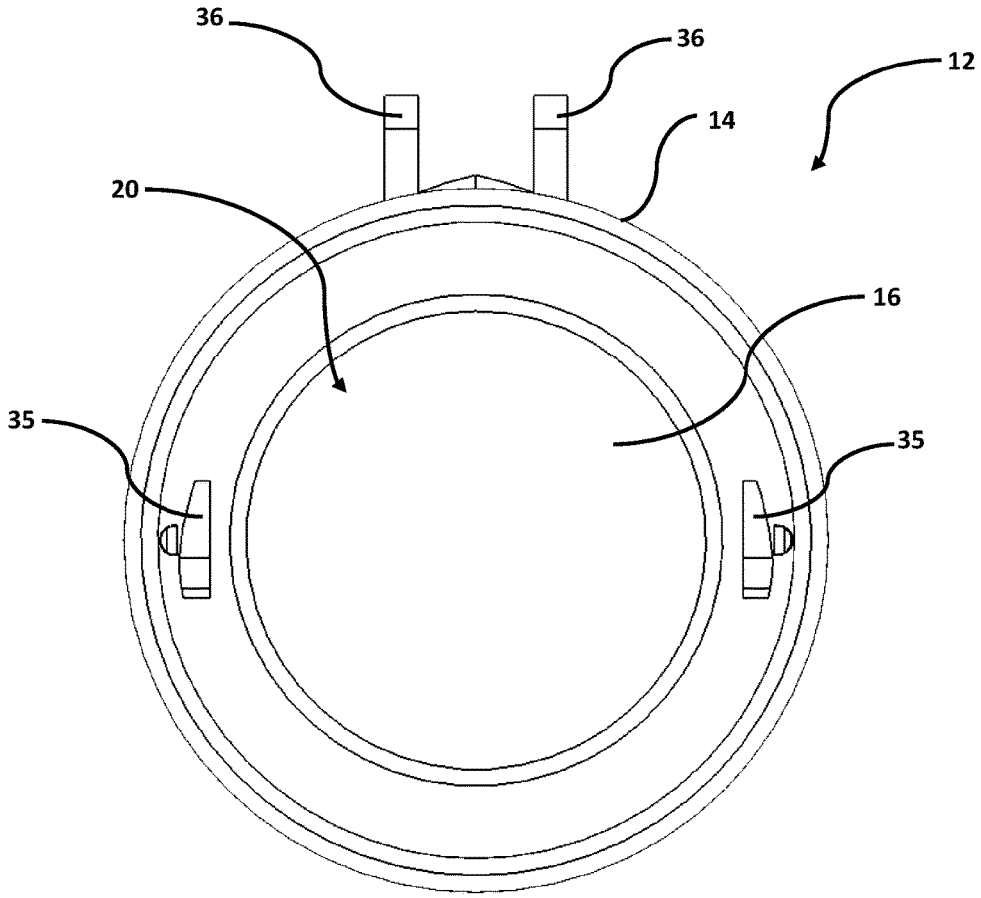
FIG. 6 is a top, plan view of the vessel body.

Turning now to FIGS. 3-6, the vessel body 12 is illustrated in further detail. As best shown in FIG. 5, the vessel body 12 includes a pair of opposed guide grooves 30 that help to ensure that the flapper 22 is positioned within the vessel body 12 in the proper orientation. The lower ends of the guide grooves 30 are formed with opposed recesses or depressions 32 that are configured to receive opposed detents 34 of the flapper 22 to retain the flapper 22 in position. The flapper 22 rotates about an axis running through the opposed depressions 32. As also shown in FIG. 5, the interior sidewall 14 of the vessel body 12 includes a pair of opposed position stops 35 that serve to limit the rotation of the flapper 22.

The body 12 also includes a pair of standoffs 36 formed on an outer surface thereof having a pair of opposed mating depressions 38 that provide a mounting mechanism for the trigger 28, as discussed hereinafter. In an embodiment, the body 12 may be molded with finger grooves 40 that provide for improved gripping and ensure proper drinking orientation.

Figure 7:
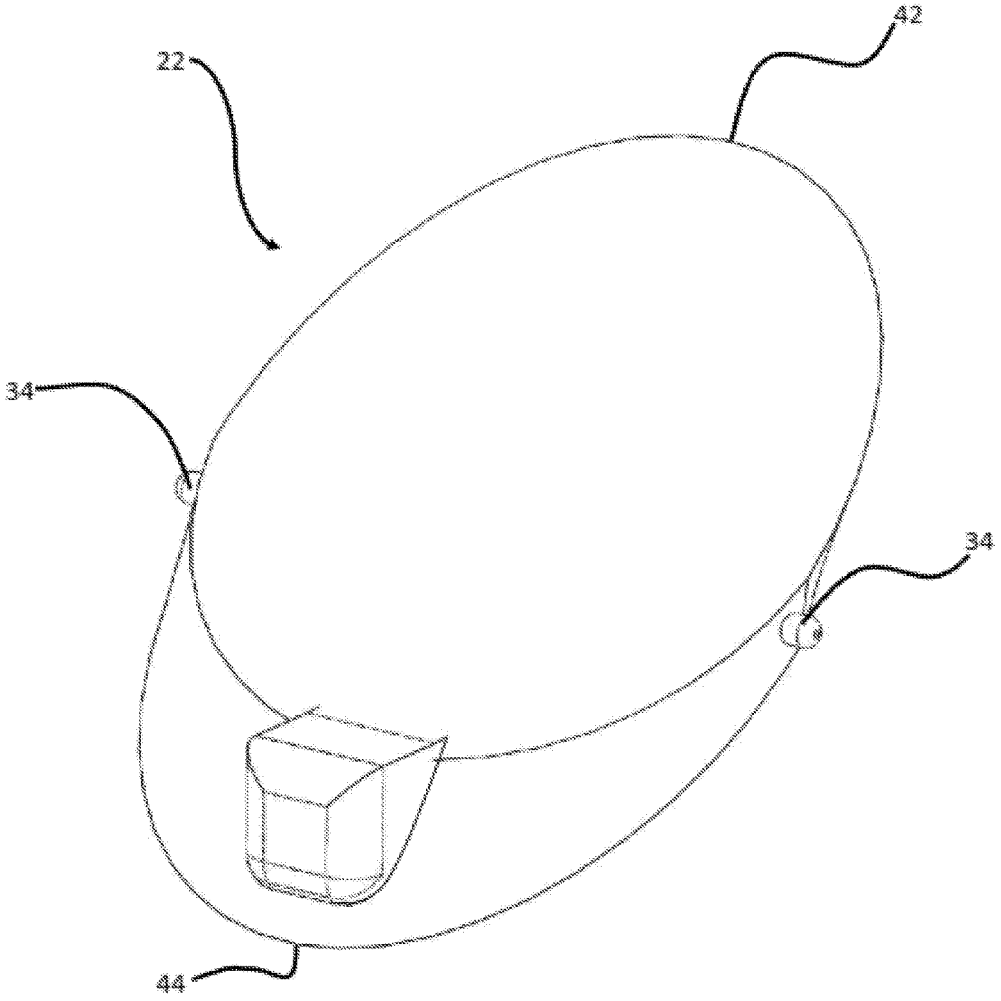
FIG. 7 is a perspective view of a flapper of the dual-chambered drinking vessel of FIG. 1.
Figure 8:
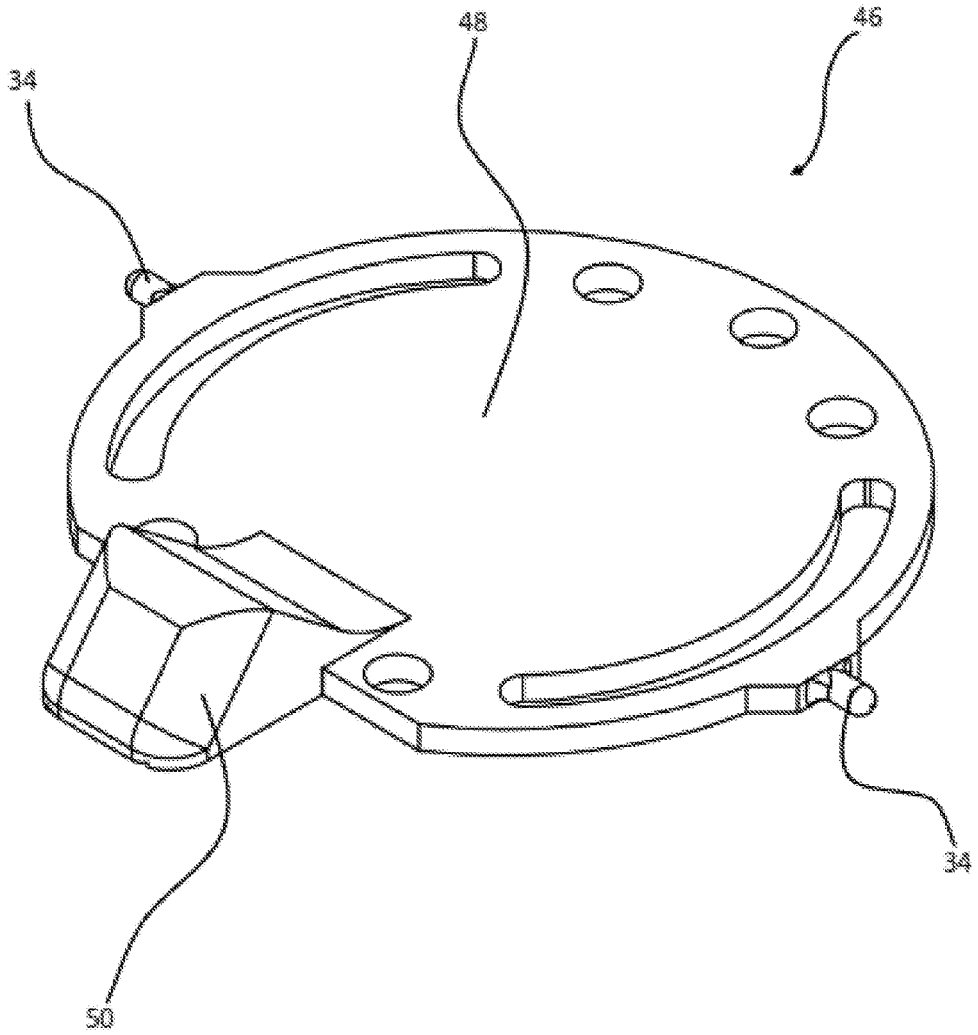
FIG. 8 is a core of the flapper of FIG. 7.
Figure 9:
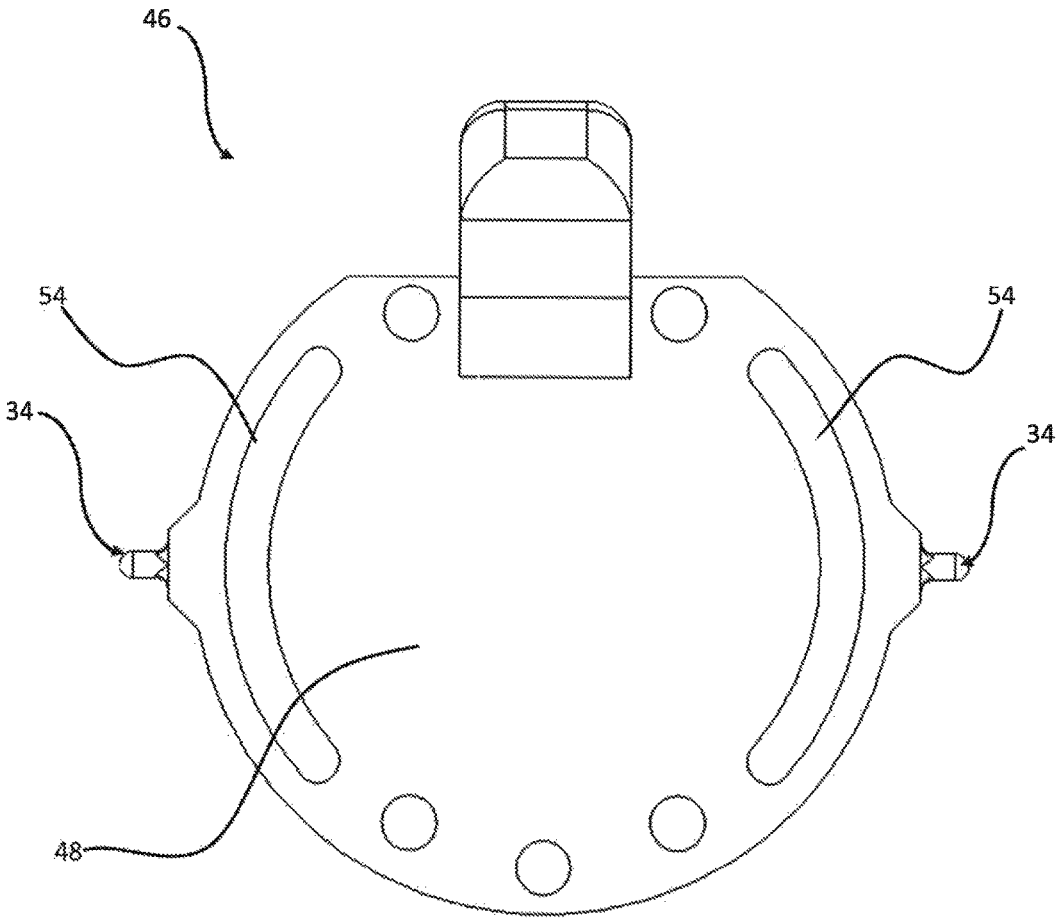
FIG. 9 is a top, plan view of the core of the flapper.

Turning now to FIG. 7, an enlarged, perspective view of the flapper 22 is shown. As discussed above, the flapper 22 is generally elliptical in shape and has opposed leading and trailing edges 42, 44. The leading and trailing edges 42, 44 are configured to sealingly contact the interior sidewall 14 of the vessel 10 to fluidly separate the upper chamber 26 from the lower chamber 24. The flapper 22 may be manufactured from an elastomer, such as silicon rubber, molded over a thermoplastic core 46, which is illustrated in FIGS. 8-11.

Figure 10:
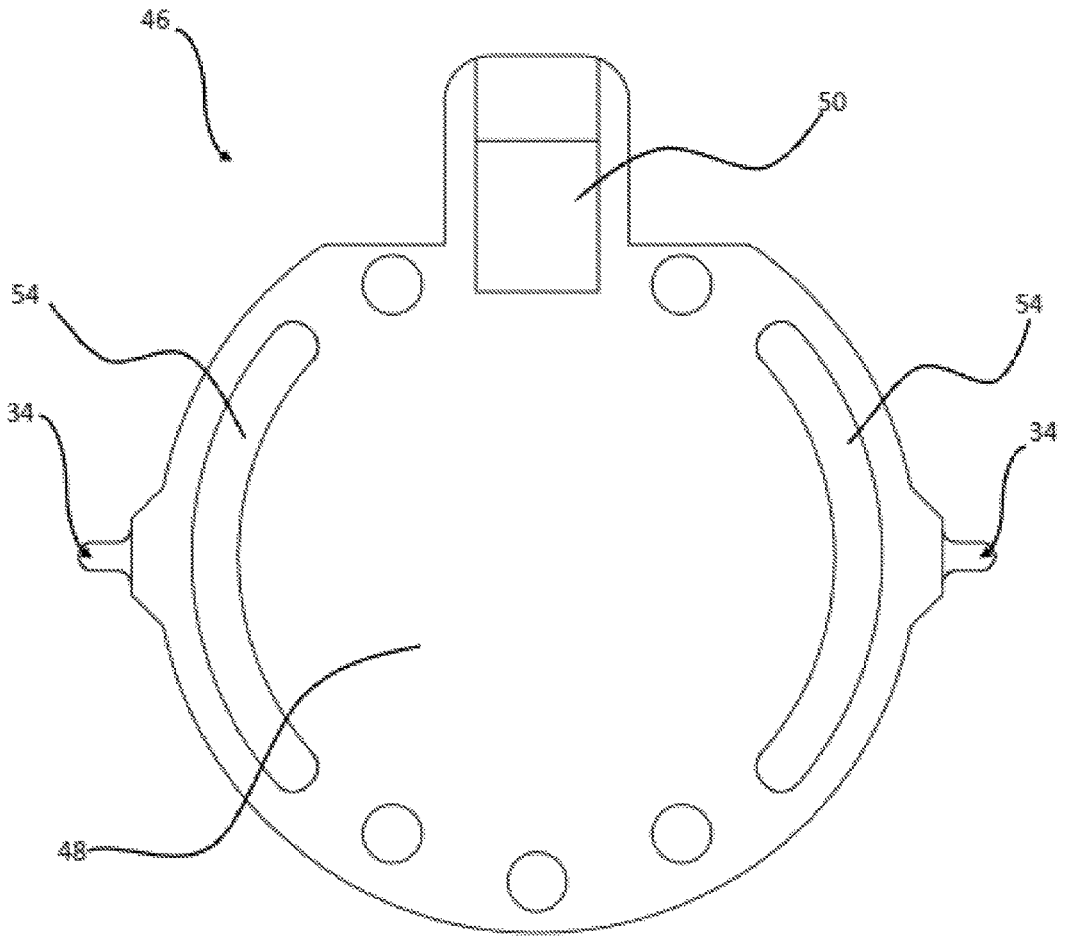
FIG. 10 is a bottom, plan view of the core of the flapper.
Figure 11:
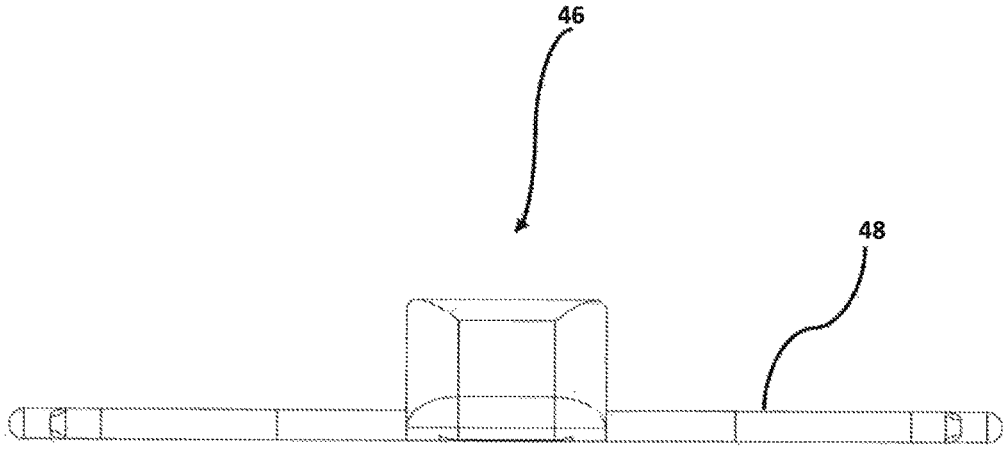
FIG. 11 is a side, elevational view of the core of the flapper.
Figure 12:
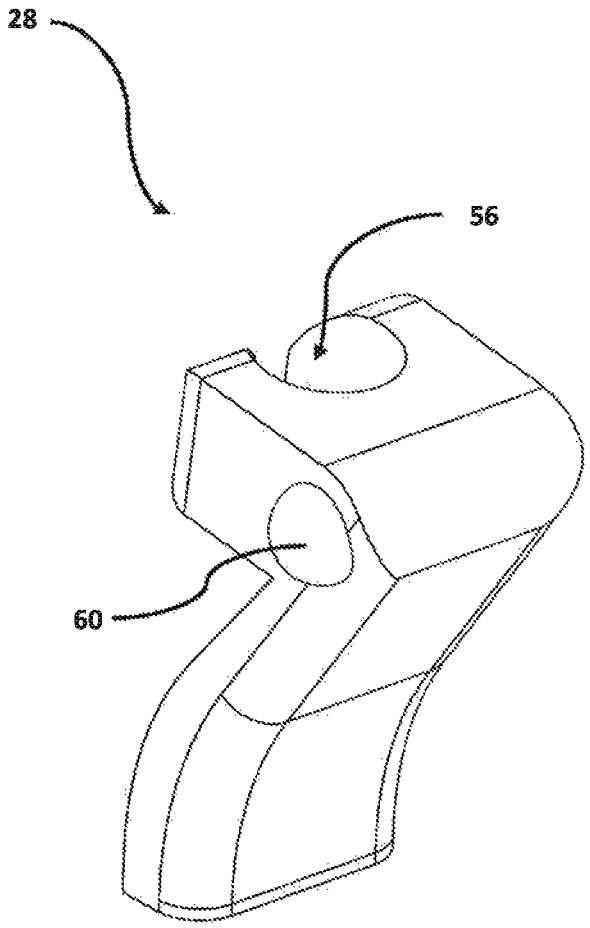
FIG. 12 is a perspective view of a trigger of the dual-chambered drinking vessel of FIG. 1.
Figure 13:
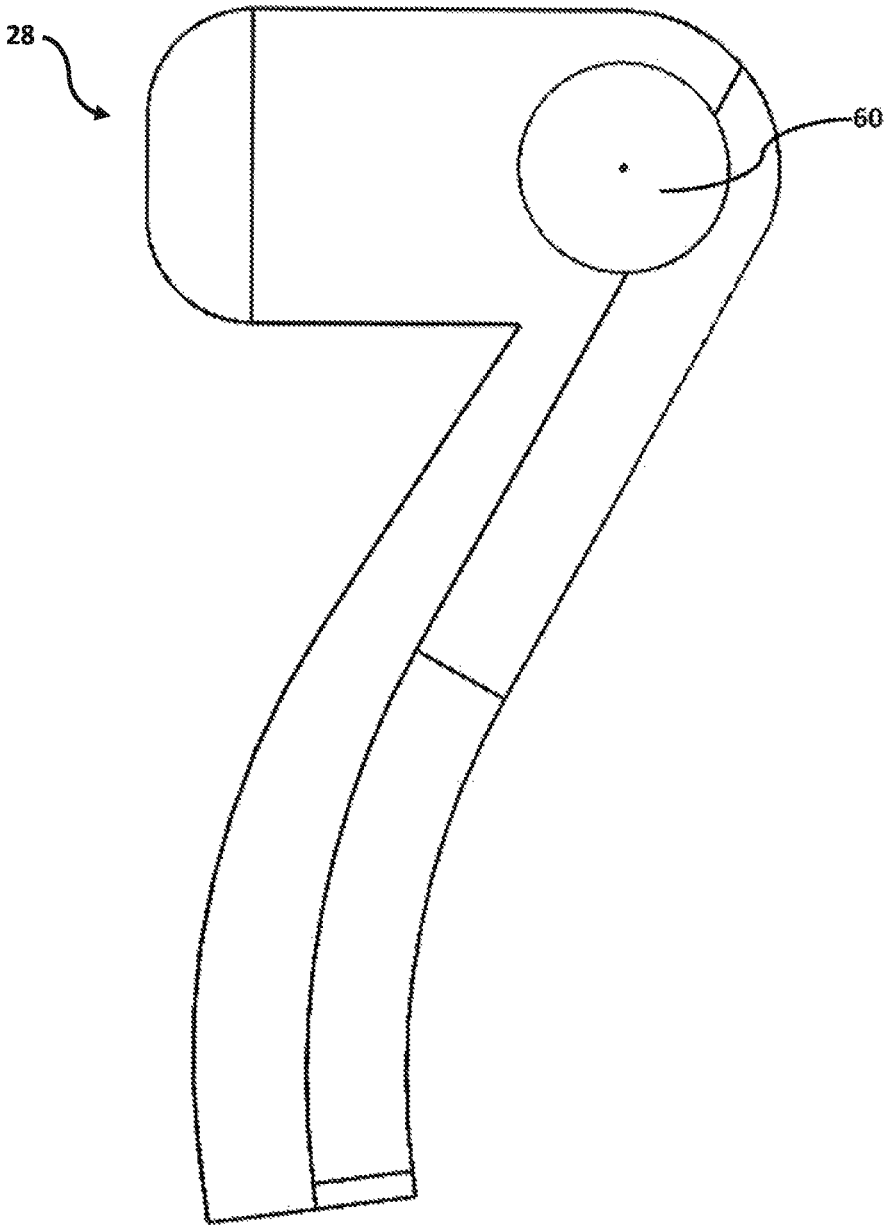
FIG. 13 is a side, elevational view of the trigger.
Figure 14:
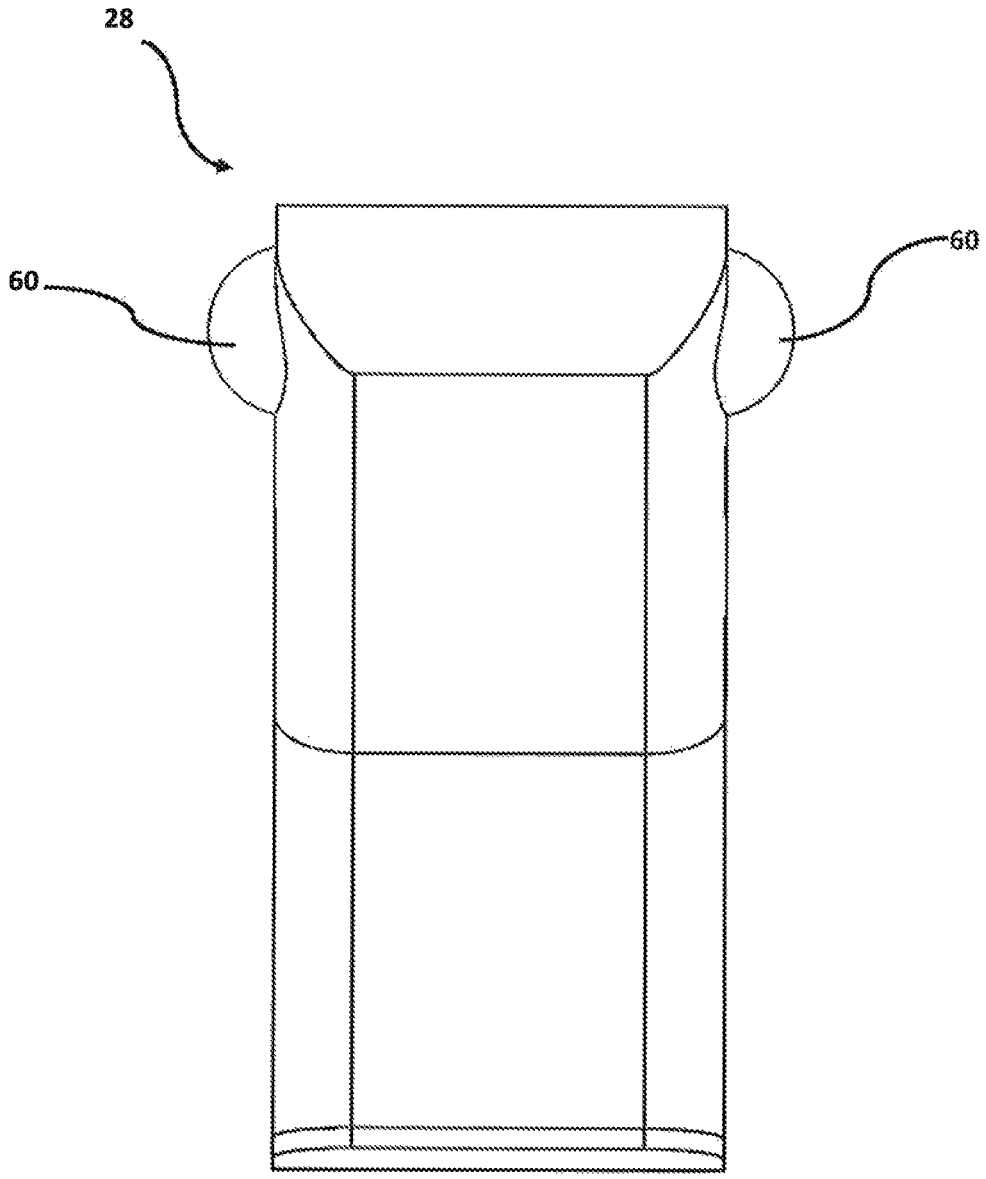
FIG. 14 is a front, elevational view of the trigger.
Figure 15:
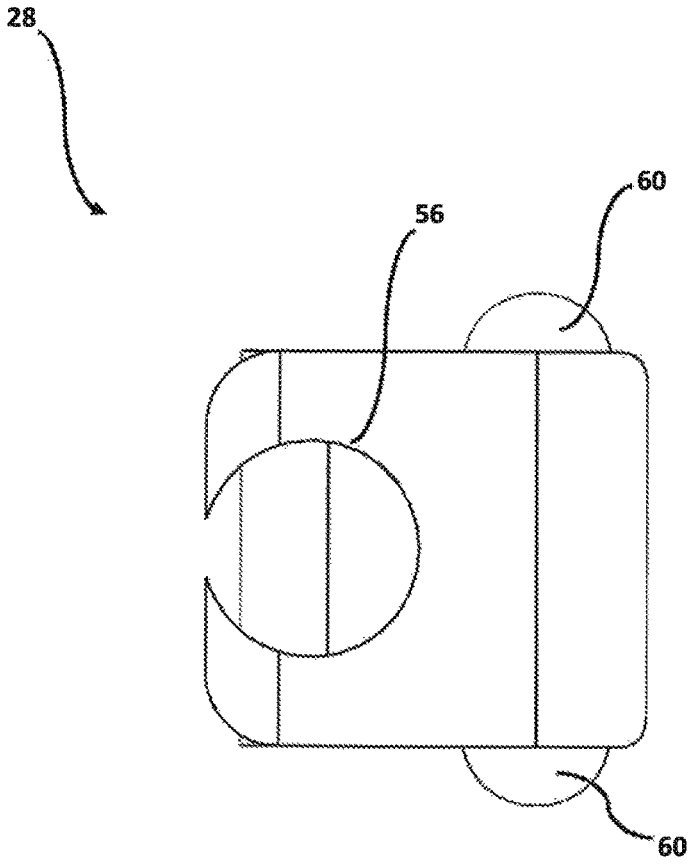
FIG. 15 is a top, plan view of the trigger.

In particular, the core 46 of the flapper 22 include a generally circular body portion 48 having the opposed detents 34 for mating with the opposed depressions 32 formed in the body 12. As best shown in FIG. 10, the core 46 includes a mating pocket 50 for accepting one or more flapper magnets 52. The body portion 48 may be formed with one or more relief gaps 54 which allow for bending of the core 46 to facilitate installation of the flapper 22 into the vessel body 12.

Referring now to FIGS. 12-15, enlarged, detail views of the trigger 28 are illustrated. The trigger 28 includes a mating pocket 56 for accepting one or more trigger magnets 58 and includes a pair of opposed trigger detents 60 that are configured to be received by depressions 38 in the standoffs 36. In an embodiment, the magnets 52, 58 are neodymium magnets.

Referring back to FIG. 1, when assembled the flapper magnet 52 is arranged immediately inside the vessel body 12 from the trigger magnet 58. As will be readily appreciated, the magnetic attraction between the magnets 52, 58, therefore, urges the flapper 22 to its closed position in which its edges are in contact with the interior sidewall 14, effectively creating a fluid seal between the lower chamber 24 and upper chamber. Depression of the trigger, such as by the thumb of a user, causes the trigger 28 to rotate, creating a greater space between the magnet 58 in the trigger 28 and the magnet 52 in the flapper, which decreases the magnetic attraction therebetween. As a result of the decrease in the magnetic attraction, the flapper 22 may rotate to its open position, allowing for fluid communication between the two chambers 24, 26.

In operation, a user may pour a first liquid, such as a chaser, into the lower chamber 24 by first depressing the trigger 28, which opens the dividing flapper 22. The chaser may then be poured into the lower chamber 24. The user may then release the trigger 28, which closes the dividing flapper 22. The user may then power a second liquid, such as an alcoholic beverage, into the upper chamber 26. The flapper 22, by sealingly engaging the interior sidewall 14 of the vessel body 12, prevents the second liquid from mixing with the first liquid, or vice versa. Once the vessel 10 is filled, the user may consume the alcoholic beverage by tilting the vessel 10 towards his or her mouth. Next, the user depresses the trigger 28 while in the tilted, drinking position, which quickly releases the chaser from the lower chamber 24 into the user's mouth. Finally, the user releases the trigger 28 which returns the hinged, dividing flapper to its closed position.

Importantly, the actuator mechanism, consisting of the magnetic trigger and corresponding magnetic flapper, provides consumers of alcoholic beverages the ability to control precisely when the chaser in the lower chamber is released. This is in contrast to existing devices which immediately release and mix the two liquids upon tilting of the vessel. Moreover, the present invention allows for simple, one-handed operation, an advantage heretofore not seen in the art. In particular, one-handed operation allows for the pouring of fluids into the vessel 10 with the free hand, allowing for faster, smoother, and more convenient operation. Indeed, one-handed operation is critical for allowing a user to transition quickly from the release of the first liquid (e.g., a shot of alcohol) to the release of the second liquid (e.g., a chaser). The unidirectional actuation mechanism therefore provides a user with full control to dispense the liquid in the lower chamber precisely when he or she is ready.

As will also be appreciated, the flapper mechanism is easily installed and is likewise easily removable for cleaning purposes. While the vessel of the present invention has been shown as containing two chambers, the present invention is not so limited in this regard. In particular, a vessel having more than two chambers may be constructed by provided additional flappers and triggers spaced vertically relatively to one another.

Figure 16:
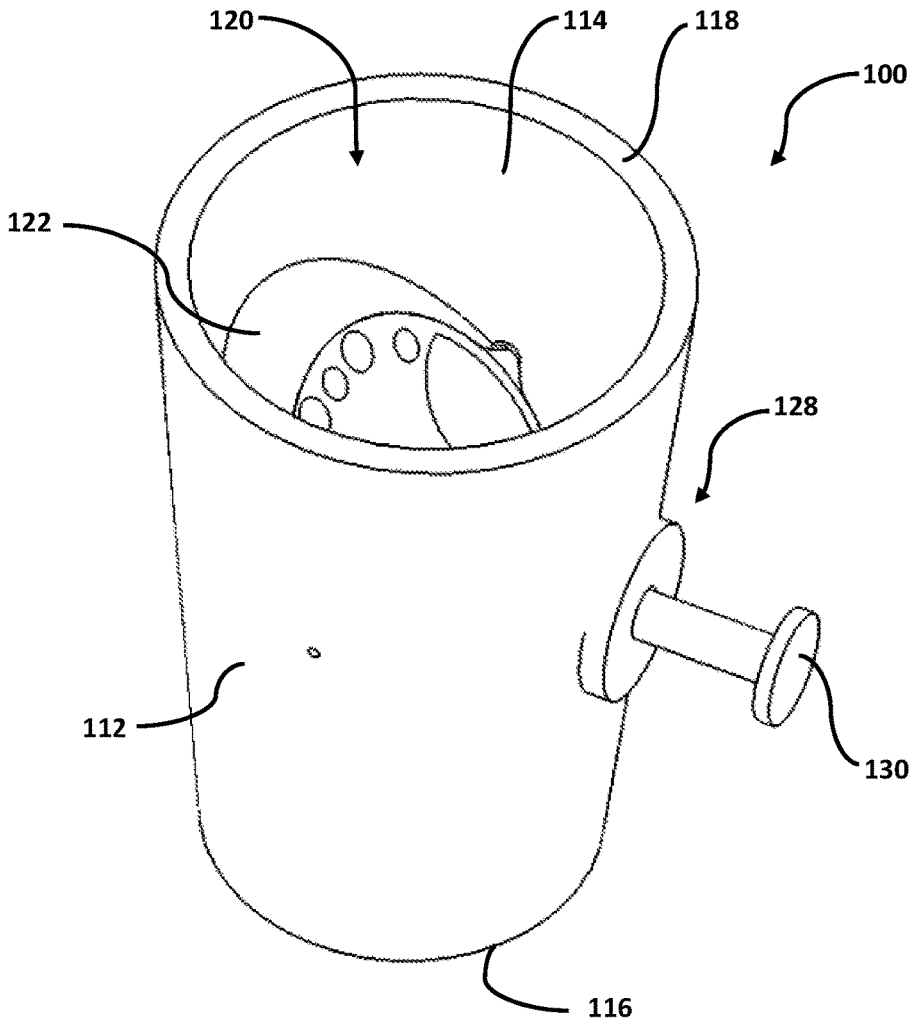
FIG. 16 is a perspective view of a dual-chambered drinking vessel in accordance with another embodiment of the present invention.
Figure 17:
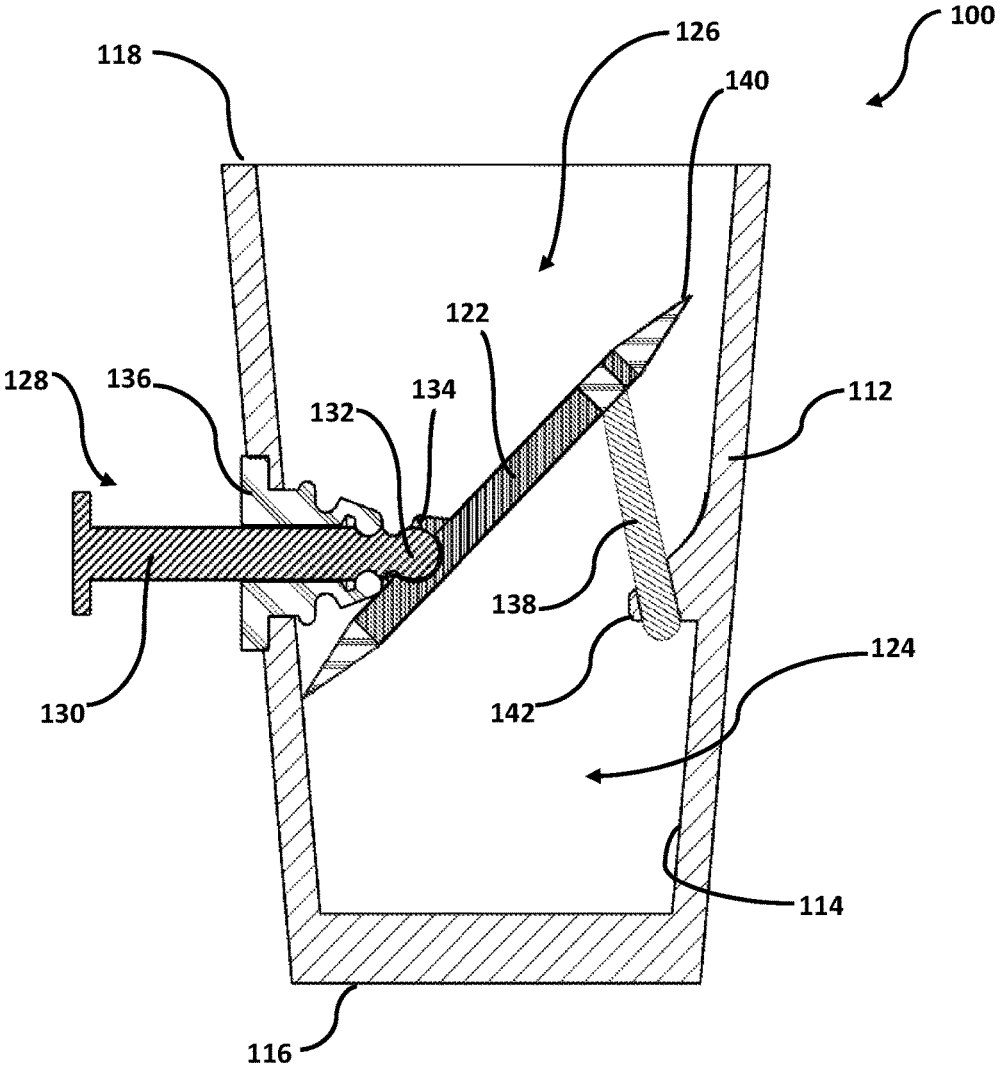
FIG. 17 is a cross-section view of the dual-chambered drinking vessel of FIG. 16.
Figure 18:
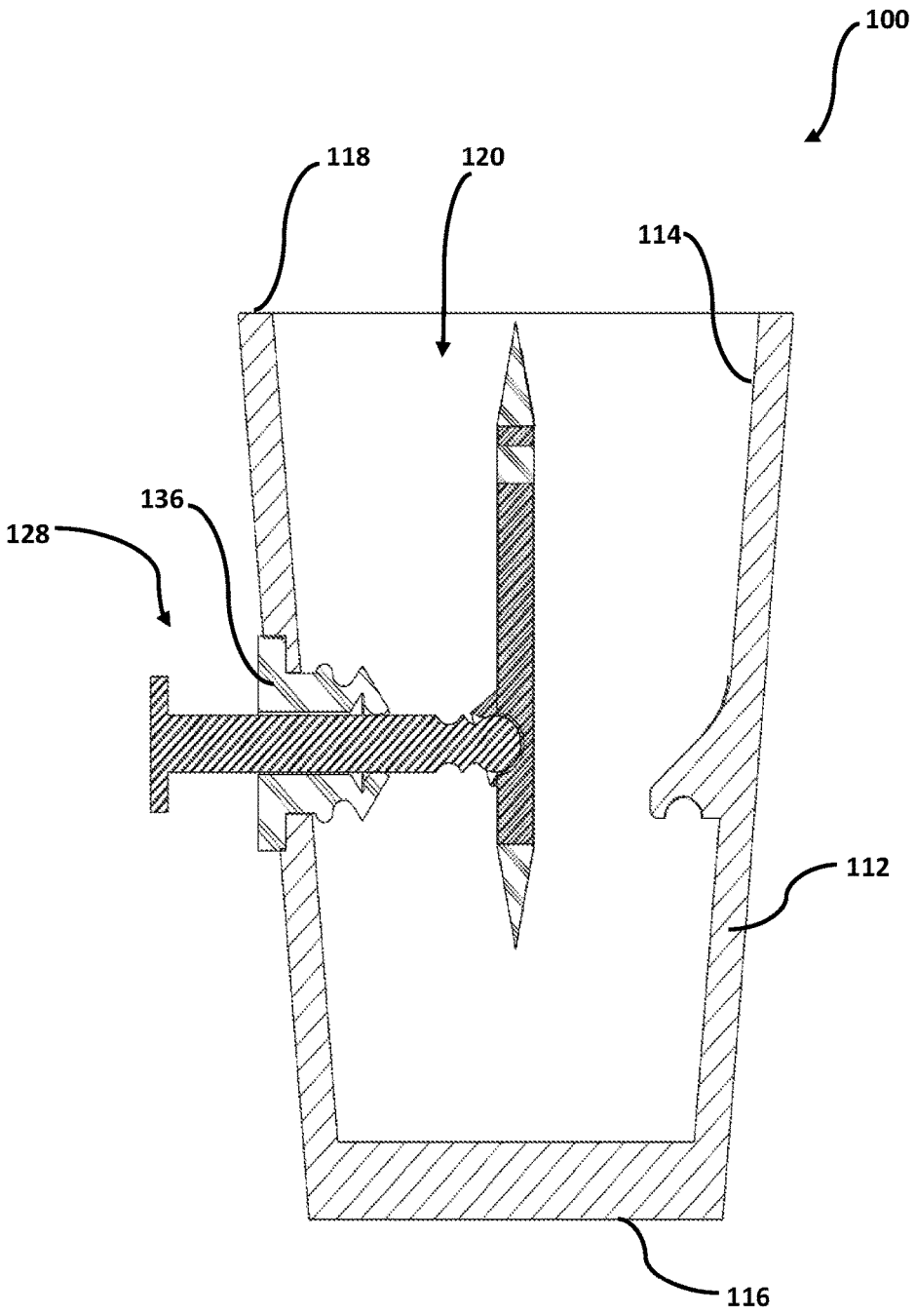
FIG. 18 is another cross-section view of the dual-chambered drinking vessel of FIG. 16.

Turning now to FIGS. 16-18, a dual-chambered drinking vessel 100 according to another embodiment of the present invention is illustrated. As shown therein, the vessel 100 is generally similar to the vessel 10 described above in connection with FIGS. 1-15 and includes a generally cylindrical or frustoconical vessel body 112 having at least one interior sidewall 114, a bottom wall 116 and a generally open top defined by rim 118. The vessel body 112 defines an interior space 120.

Like vessel 10, vessel 100 includes a baffle or dividing flapper 122 pivotally mounted to opposing sidewalls 114 of the vessel 100 within the interior space 120. The flapper 122 is sized and shaped to sealingly contact the interior walls 114 of the vessel 100, and divides the interior space 120 into a lower chamber 124 and an upper chamber 126. The flapper 122 is selectively movable between a closed position, in which the flapper 122 sealingly contacts the interior walls 114 of the vessel 100 to divide the interior space 120 into the lower and upper chambers 124, 126, and an open position, in which the flapper 122 is generally spaced from the interior sidewalls 114 allowing fluid communication between the lower chamber 124 and upper chamber 126.

With further reference to FIGS. 16-18, the vessel 100 also includes an actuator mechanism 128 that is selectively actuatable to move flapper 122 between its closed position and open position. The actuator mechanism 128 includes a pushbutton 130 that extends axially into the vessel 100 through the sidewall 114 and terminates in a distal end having a ball 132. The ball 132 is received in a corresponding socket 134 formed on a lower end of the flapper 122. The pushbutton 130 is axially movable into and out of the vessel 100 to open or close the lower chamber 124, in the manner discussed hereinafter. Although FIGS. 16-18 illustrate a ball and socket connection between the pushbutton 130 and flapper 122, other means of connection between these components may also be utilized without departing from the broader aspects of the present invention. In particular, the connection may be a mechanical linkage, hydraulic linkage, magnetic linkage, pneumatic linkage or the like.

The vessel 100 also includes a bellow 136 formed from an elastomeric or polymeric material that surrounds the axial shaft of the pushbutton 132 to provide a watertight seal between the pushbutton and the vessel 100 to prevent the egress of liquid. In an embodiment, the bellow 136 may be formed from rubber or other sufficiently flexible material such as silicone, urethane or plastic.

In an embodiment, the dividing flapper 122 may include an elastomeric tensioning member 138 (e.g., a spring, elastomer) that facilitates sealing engagement between the flapper 122 and the vessel body 112 when the flapper 122 is in the closed position. As best shown in FIG. 17, the elastomeric tensioning member 138 may extend between the flapper 122 adjacent to a leading edge 140 thereof and a protrusion 142 extending into the vessel 100 from an internal sidewall 114 thereof. The tensioning member 138 applies rotational movement of the dividing flapper 122 to create a fluid tight seal with the vessel body 112.

In operation, the tensioning member 138 exerts a rotational biasing force sufficient to create a fluid-tight seal between the edges of the flapper 122 and the internal sidewalls of the vessel body 112. When a user desires to take a shot, followed by a chaser, the button 132 may be depressed, which rotates the flapper 122 to its open position, against the elastic bias. A chaser may then be poured into the lower chamber 124. Releasing the button 132 automatically causes the flapper to move to its closed position, at which time a shot of alcohol or other liquid may be poured into the upper chamber 126. As will be readily appreciated, the fluid-tight seal prevents the alcohol from entering the lower chamber 124. A user may then tip the vessel 100 to consume the alcohol in the upper chamber 126, and then actuate the pushbutton 132 at any desired time to release the chaser from the lower chamber 124.

Figure 19:
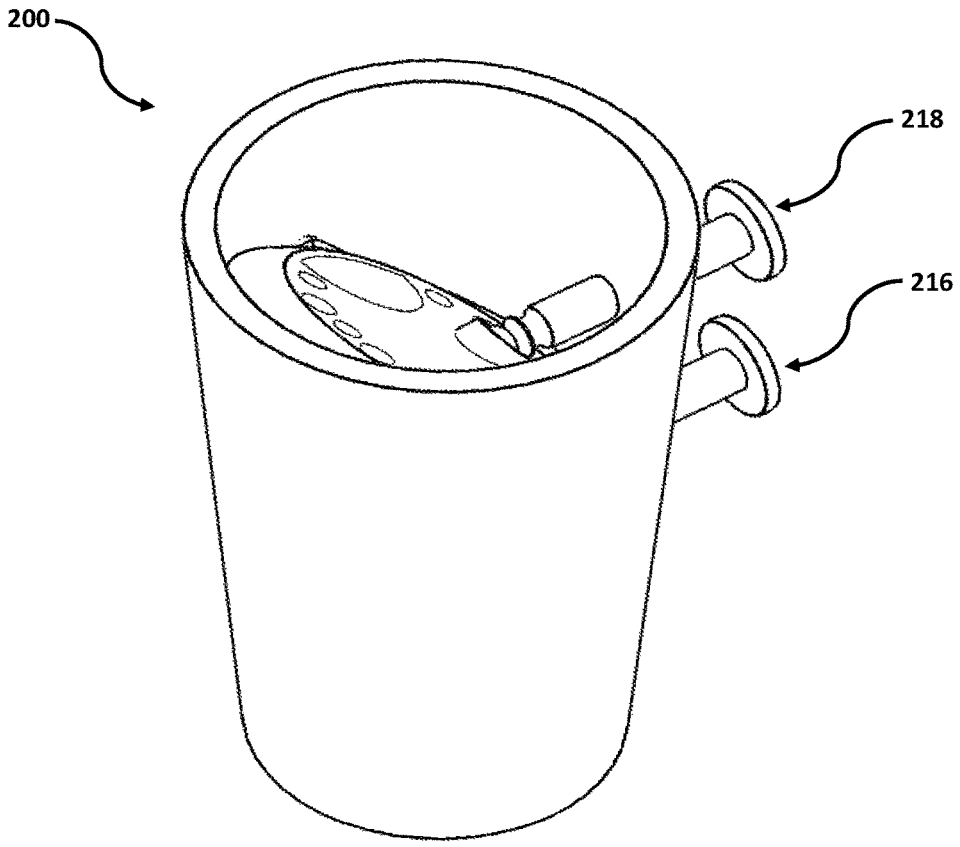
FIG. 19 is a perspective view of a multi-chambered drinking vessel according to another embodiment of the present invention.
Figure 20:
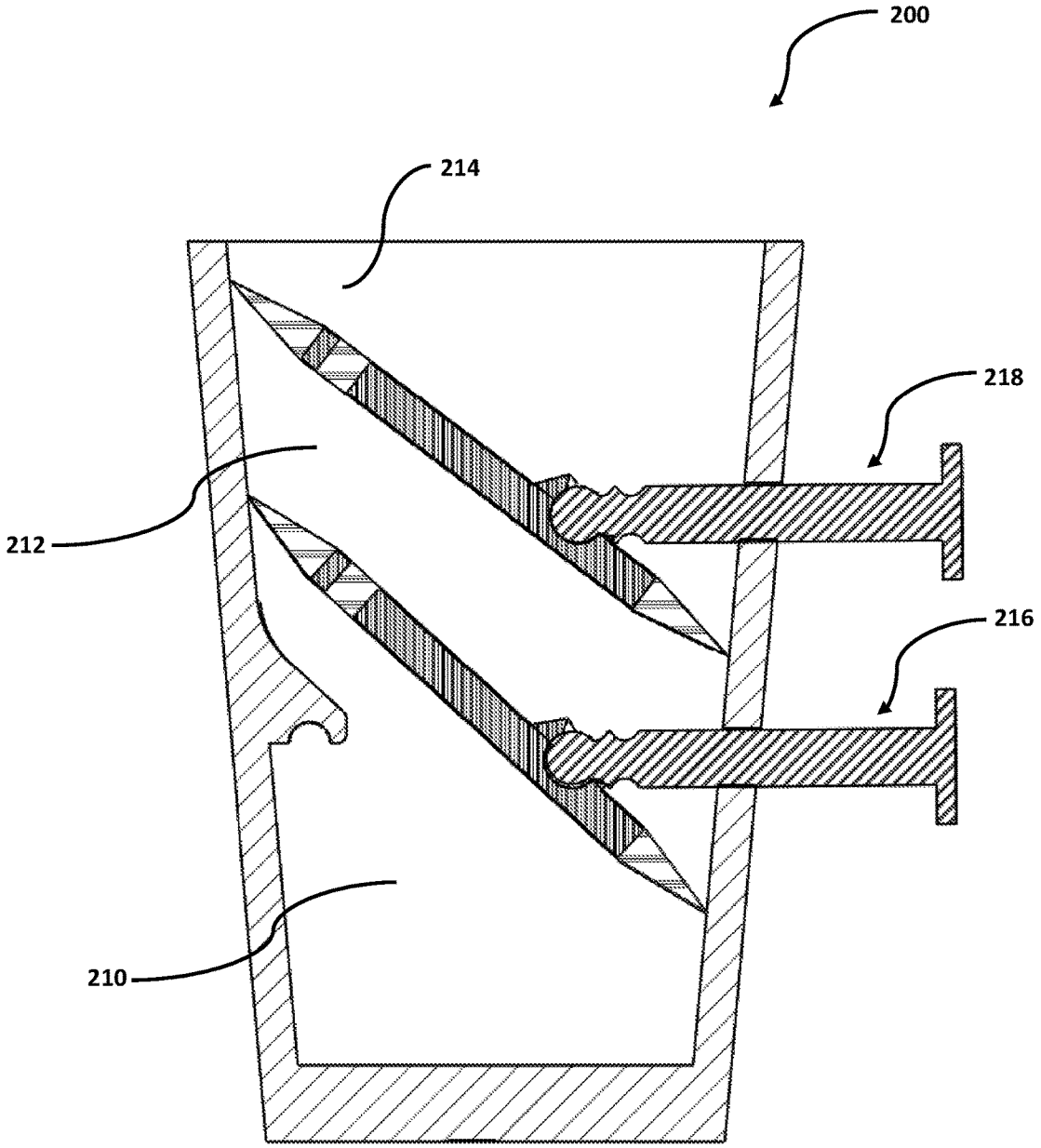
FIG. 20 is a cross-sectional view of the multi-chambered drinking vessel of FIG. 19.
Figure 21:
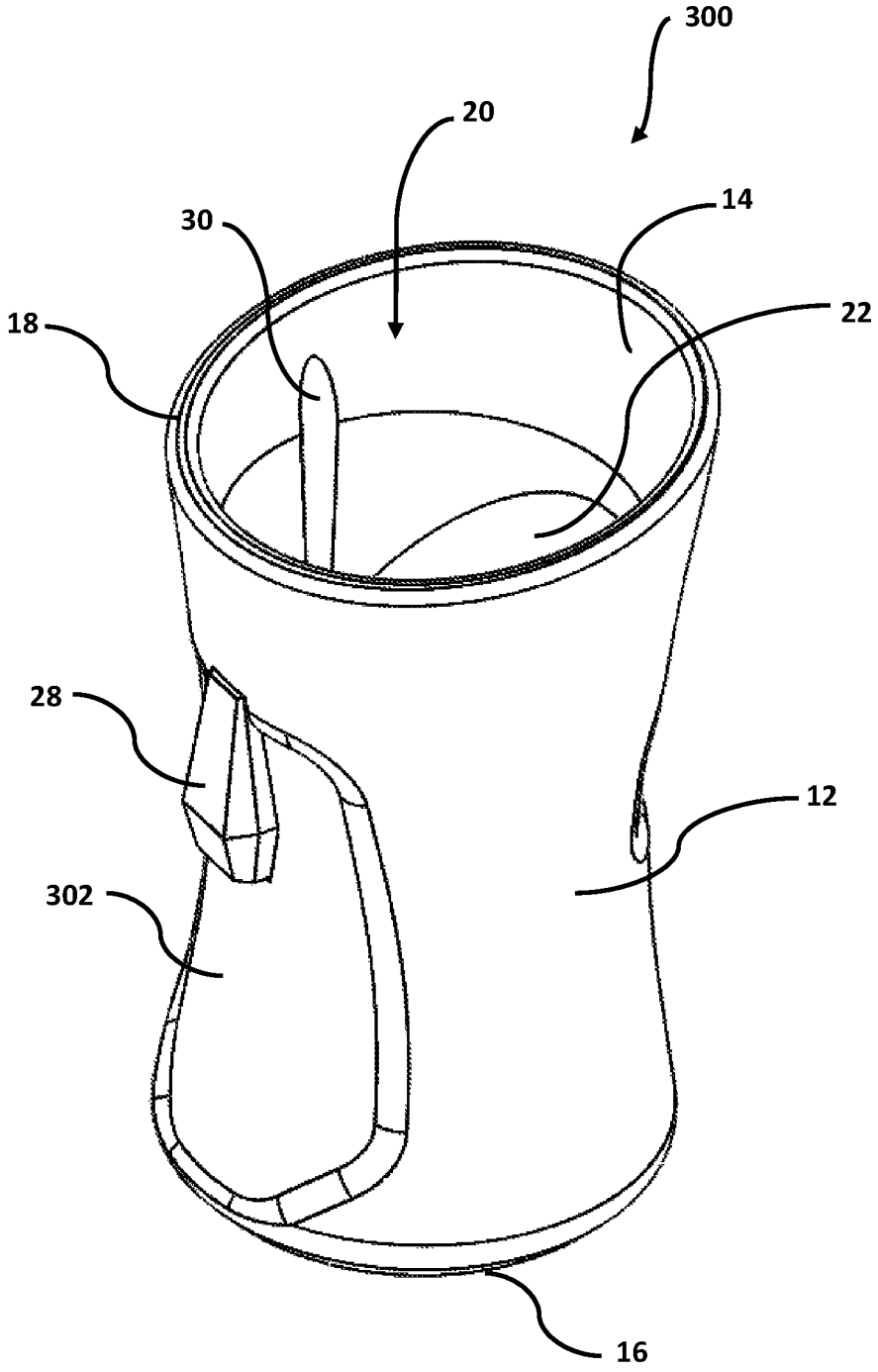
FIG. 21 is a perspective view of a dual-chambered drinking vessel in accordance with another embodiment of the present invention.

As alluded to above, the multi-chambered drinking vessel of the present invention may have more than two chambers. For example, FIGS. 19 and 20 illustrate a three-chambered drinking vessel 200 having a lower chamber 210, a middle chamber 212 and an upper chamber 214. The chambers 210, 212, 214 may be formed by providing a plurality of actuator members 216, 218. In particular, the lower chamber 210 may be defined between a bottom wall of the vessel and a first actuator member 216. The middle chamber 212 may be defined between the first actuator member 216 and a second actuator member 218. Finally, the upper chamber may be defined above the second actuator member 218. The actuator members 216, 218 may take the form of the actuators described and shown in connection with FIGS. 16-18 or FIGS. 1-15. In an embodiment, the actuators may be connected by a linkage or other means so that they operate in unison.

Figure 22:
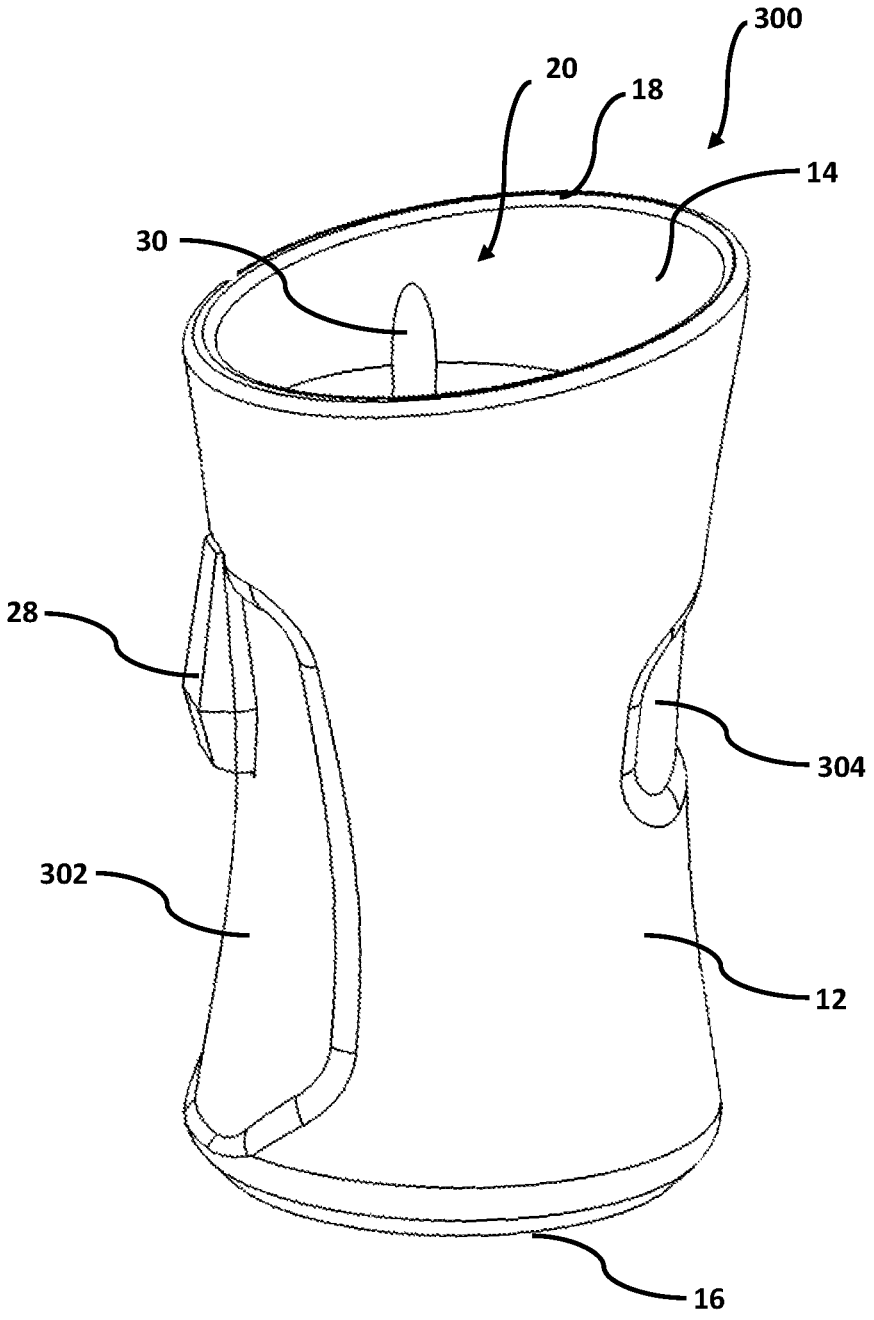
FIG. 22 is another perspective view of the dual-chambered drinking vessel of FIG. 21.
Figure 23:
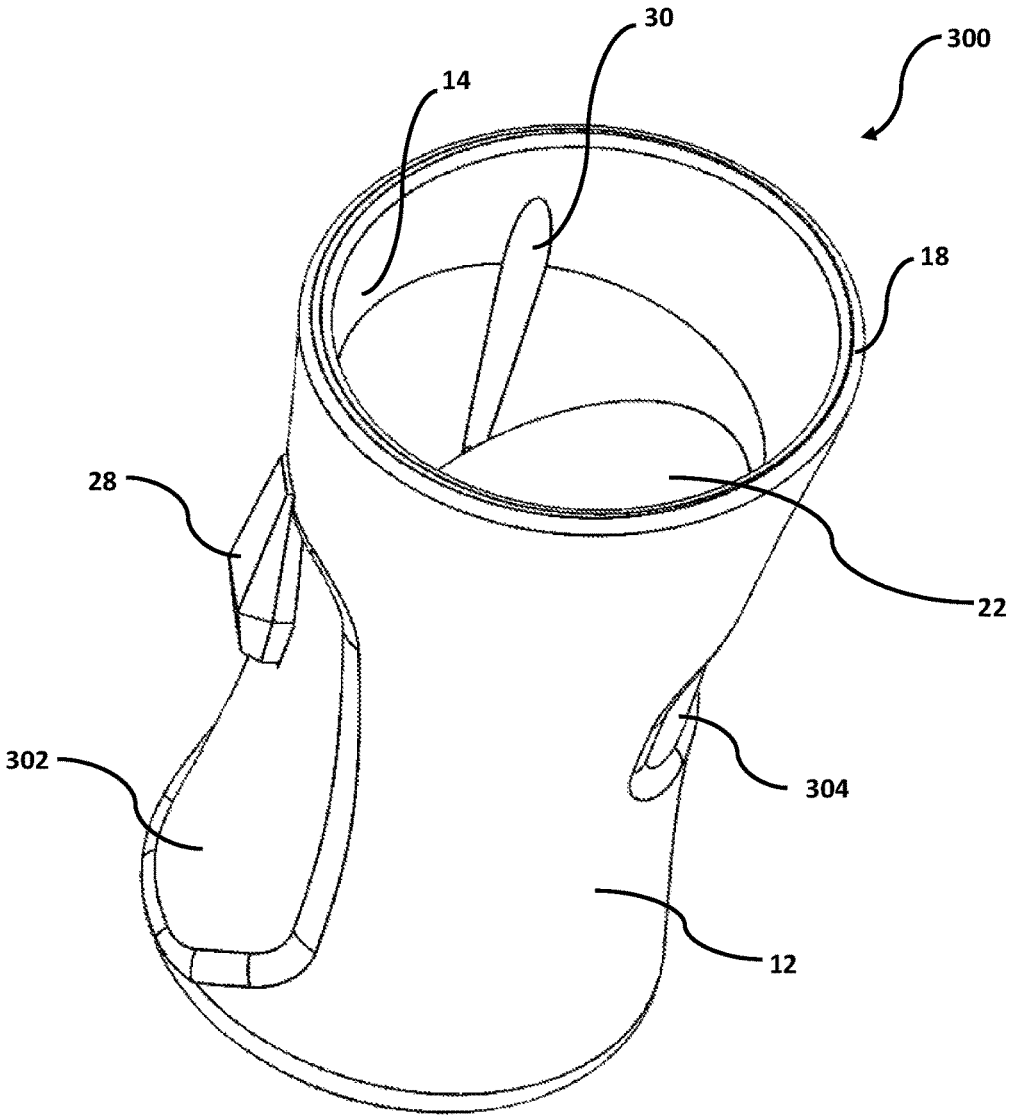
FIG. 23 is a top, perspective view of the dual-chambered drinking vessel of FIG. 21.
Figure 24:
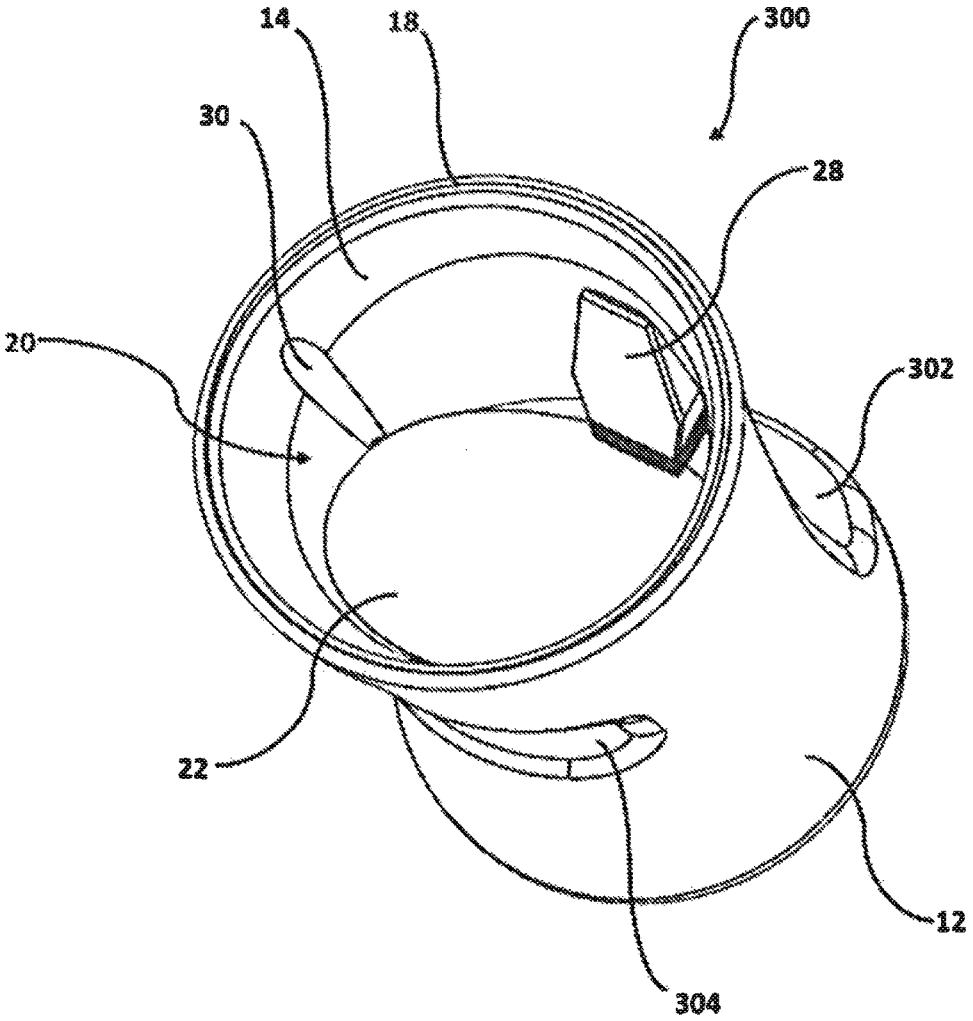
FIG. 24 is another top, perspective view of the dual-chambered drinking vessel of FIG. 21.

Turning now to FIGS. 21-24, a multi-chambered drinking vessel 300 according to another embodiment of the present invention is illustrated. The multi-chambered drinking vessel 300 is generally similar to the drinking vessel 100 of FIGS. 1-15 in both its configuration and method operation, where like reference numerals designate like parts. In contrast to the generally cylindrical shape of vessel 100, however, vessel 300 has a tapered body 12 having a wider base and top and a narrower middle which provides a more ergonomic feel. As best shown in FIG. 22, the top rim 18 of the vessel 300 is angled such that the height of the vessel 300 is shorter on the side of the trigger 28 and higher on the side opposite the trigger 28. As also shown in FIGS. 21-24, the vessel has depressions or relieved portions 302, 304 that provide gripping areas for a user's hand and, in particular, a user's thumb and pointer finger.

In any of the various embodiments described above, the vessel may be constructed of any material known in the art, such as plastic, glass or metal, so long as the material is durable and easily cleanable. Preferably, the vessel is sufficiently tall and large enough in diameter to contain a drinkable amount of liquid. In an embodiment, the vessel can preferably hold from about one to about eight ounces of liquid in each of the chambers, is approximately three to ten inches in height and is approximately one to three inches at its largest diameter.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of this disclosure.

What is claimed is:

1. A dual-chambered drinking vessel, comprising:

a vessel body having at least one sidewall, a bottom and an open top defining an interior space;

a flapper disposed within said interior space and pivotally connected to an inner wall of said vessel body, said flapper being movable between a closed position in which said flapper divides said interior space into an upper chamber and a lower chamber and substantially prevents fluid communication between said upper chamber and said lower chamber, and an open position in which said upper chamber is in fluid communication with said lower chamber; and a magnetic trigger including a trigger body pivotally coupled to said vessel body and a first magnet housed in said trigger body;

wherein said flapper includes a second magnet adjacent to a lower edge of said flapper;

wherein said first magnet and said second magnet are positioned on opposing sides of said at least one sidewall; and wherein said magnetic trigger is selectively actuatable to effect movement of said flapper from said closed position to said open position.

2. The dual-chambered drinking vessel of claim 1, wherein:

said first magnet and said second magnet are neodymium magnets.

3. The dual-chambered drinking vessel of claim 1, wherein:

said magnetic trigger is rotatable relative to said vessel body between a first magnet position in which said first magnet is spaced from said second magnet by a first distance, and a second magnet position in which said first magnet is spaced from said second magnet by a second distance, said second distance being greater than said first distance.

4. The dual-chambered drinking vessel of claim 3, wherein:

said second magnet position corresponds to said open position of said flapper.

5. The dual-chambered drinking vessel of claim 2, wherein:

said vessel body includes a pair of opposing grooves formed in opposing sides of said inner wall, said grooves being configured to slidably receive detents extending from opposing sides of said flapper.

6. The dual-chambered drinking vessel of claim 5, wherein:

said vessel body includes a pair of opposed position stops on said inner wall, said position stops being configured to limit rotation of said flapper.

7. The dual-chambered drinking vessel of claim 1, further comprising:

at least one finger groove formed on said sidewall of said vessel body.

8. A vessel, comprising:

a vessel body defining an interior space;

a dividing flapper pivotally connected to an inner wall of said vessel body, said dividing flapper separating said interior space into an upper chamber and a lower chamber; and an actuator configured to selectively move said dividing flapper between a first position, in which said dividing flapper sealingly engages said inner wall to prevent fluid communication between said upper chamber and said lower chamber, and a second position, in which said dividing flapper is oriented so as to allow fluid to flow between said upper chamber and said lower chamber;

wherein said dividing flapper includes a flapper magnet positioned adjacent to said inner wall of said vessel; and wherein said actuator includes a magnetic trigger pivotally mounted to an exterior surface of the vessel body, said magnetic trigger including a trigger magnet.

9. The vessel of claim 8, wherein:

said flapper magnet and said trigger magnet are neodymium magnets.

10. The vessel of claim 8, wherein:

said magnetic trigger is rotatable relative to said vessel body between a first magnet position in which said trigger magnet is spaced from said flapper magnet by a first distance, and a second magnet position in which said trigger magnet is spaced from said flapper magnet by a second distance, said second distance being greater than said first distance.

11. The vessel of claim 10, wherein:

said second magnet position corresponds to said second position of said flapper.

12. The vessel of claim 11, wherein:

said vessel body includes a pair of opposed position stops on said inner wall, said position stops being configured to limit rotation of said dividing flapper.

* * * * *